US006039539A

United States Patent [19]

Berg

[11] Patent Number: 6,039,539

[45] Date of Patent: Mar. 21, 2000

[54] RADIAL FAN WHEEL

[76] Inventor: Gunnar Berg, Hasselgatan 22, S-521 30 Falköping, Sweden

[21] Appl. No.: 09/155,137

[22] PCT Filed: Sep. 6, 1996

[86] PCT No.: PCT/SE96/01106

§ 371 Date: Jun. 8, 1998

§ 102(e) Date: Jun. 8, 1998

[87] PCT Pub. No.: WO97/09535

PCT Pub. Date: Mar. 13, 1997

[30] Foreign Application Priority Data

Sep. 7, 1995 [SE] Sweden ..... 9503075

[51] Int. Cl.[7] ..... B63H 1/28

[52] U.S. Cl. ..... 416/186 R; 416/189; 416/192; 416/223 B; 415/119

[58] Field of Search ..... 415/119; 416/186 R, 416/185, 223 B, 189, 192

[56] References Cited

U.S. PATENT DOCUMENTS 3,515,498 6/1970 Tomita ..... 415/208
3,584,968 6/1971 Keith ..... 415/210
4,647,271 3/1987 Nagai et al. ..... 416/186 R
5,328,332 7/1994 Chiang ..... 416/186 R
5,336,050 8/1994 Guida et al. ..... 416/186 R

*Primary Examiner*—Edward K. Look
*Assistant Examiner*—Ninh Nguyen
*Attorney, Agent, or Firm*—Marshall, O'Toole, Gerstein, Murray & Borun

[57] ABSTRACT

A radial fan wheel comprising a number of fan blades symmetrically arranged with substantially equal spacing around the rotational shaft of the fan wheel. The blades are mounted between two end plates that are arranged perpendicularly to the shaft and are provided with blade surfaces which are substantially parallel to the shaft and each of which blade extends from one point at a distance from the shaft and substantially arched in the direction outwardly towards the periphery of the wheel. One first end plate is provided with a central air inlet and is shaped with a curve that, in a position radially outwardly from the innermost edges of the blades, substantially arches towards the second end plate and further radially outwardly towards the peripheral edges of the blades. Each blade is so designed in the peripheral segment that the blade extends radially longer outwardly adjacent the first end plate than the second end plate.

3 Claims, 2 Drawing Sheets

RADIAL FAN WHEEL

FIELD OF THE INVENTION

The present invention refers to a radial fan wheel comprising a number of fan blades symmetrically arranged with substantially equal spacing around the rotational shaft of the fan wheel, said blades being mounted between two perpendicular to said shaft arranged end plates and being provided with surfaces which are substantially parallel with said shaft and each of which extends from one point at a distance from said shaft and substantially arched in the direction out to the periphery of the wheel, wherein one end plate is provided with a central air inlet.

BACKGROUND OF THE INVENTION

Fans are used as means for driving air through ventilation systems. Efficiency and a low level of noise are requirements upon fans. The most common type of fans in the field of ventilation, are double suction radial fans. They have a high degree of efficiency but the level of noise requires subsequent silencers. A problem with double suction radial fans, is that the outlet velocity is high and uneven. This makes it impossible to place subsequent silencers immediately in connection to the fan. In recent time, chamber fans which is an old design, has come back to the market. They have the advantage that they provide a flow having a low and fairly even velocity. The fan is compact and a silencer may be placed closer to the fan. The lower maximum degree of efficiency for a chamber fan is compensated by the lower velocity and the accompanying lower pressure losses, so that for high flows, chamber fans obtains higher efficiency than double suction radial fans.

Fans are the cause of low frequency noise which is difficult to muffle. It is true that the level of noise in a ventilation system may be reduced by the use of silencers. However, this is a space consuming and expensive solution of the problem.

The primary sound source in a chamber fan is the fan wheel, which for example generates noise in the frequency range 50–300 Hz. The periphery of the fan wheel is preferably symmetrically shaped with blade edges extending substantially in parallel with the rotation shaft of the wheel. The blades are located between two lateral to said shaft arranged, mutually substantially parallel end plates. The generation of noise is predominantly caused by turbulence being created when the air is pressed radially out of the wheel by the rotation of the blades, and then is brought to flow on, e.g. axially, by the design of the chamber walls.

THE TECHNICAL PROBLEM

One object of the present invention is therefore to provide a fan wheel which reduces the generation of noise in a fan, with preserved efficiency, alternatively enabling an increased efficiency with preserved noise level.

THE SOLUTION

For this object, the invention is characterized in that the end plate which is provided with the air inlet is shaped with a curve extending substantially arched from the inlet edge, in the direction toward the other end plate and further radially out toward the peripheral edge which is curved away from the other end plate, and that each blade is so designed in a peripheral segment, that the blade extends radially longer adjacent the end plate which is provided with the air inlet than at the other end plate. By this design of the fan wheel, a reduced level of noise is achieved, without any appreciable reduction of the working capacity of the fan.

DESCRIPTION OF THE DRAWINGS

The invention will be described hereinafter with reference to embodiments that are shown in the enclosed drawings, wherein FIG. 1 in a partly broken plane view shows a fan wheel which is designed according to the invention.

DESCRIPTION OF AN EMBODIMENT

The radial fan wheels shown in the figures comprise a number of fan blades 10 being symmetrically arranged with substantially equal spacing around the rotational shaft 11 of the fan wheel. The blades 10 are mounted between two perpendicular to said shaft arranged end plates 12, 13 and they are provided with blade surfaces which are substantially parallel with said shaft. Each blade extends from one point at a distance from said shaft and substantially arched in the direction out to the periphery of the wheel.

Figure 1:
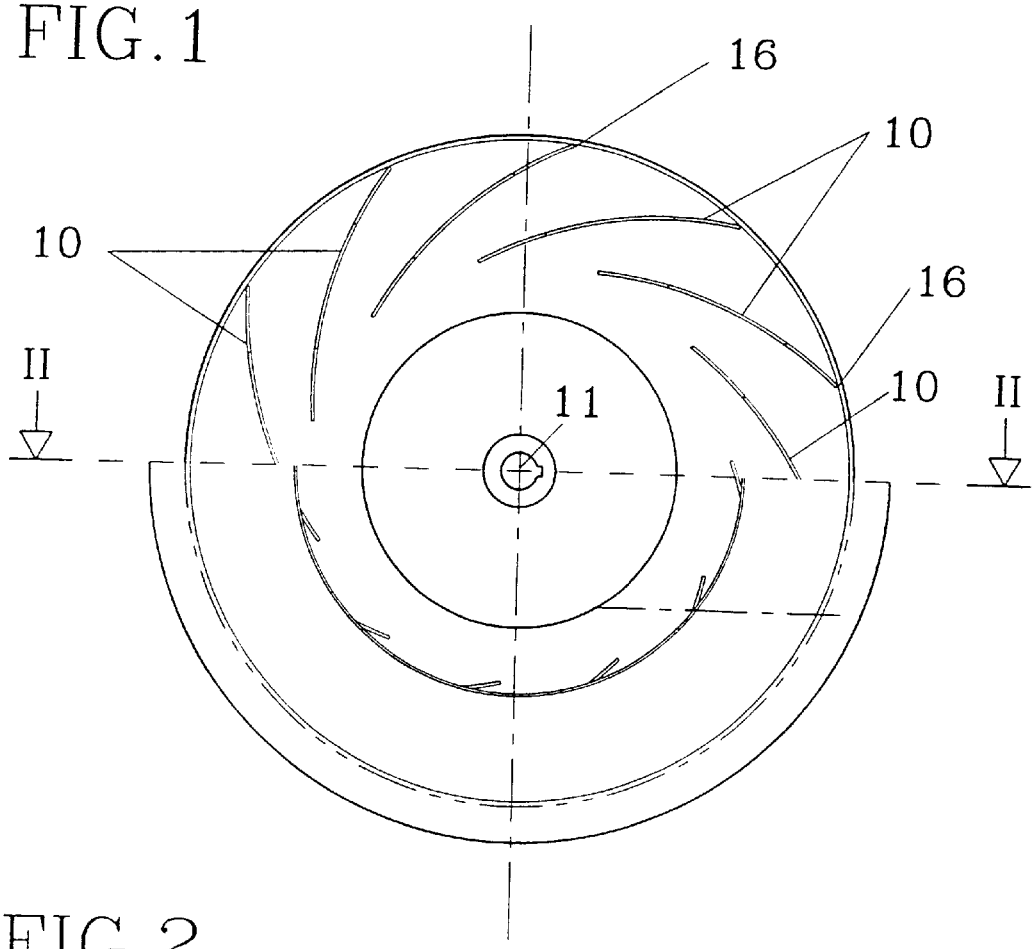
Figure 2:
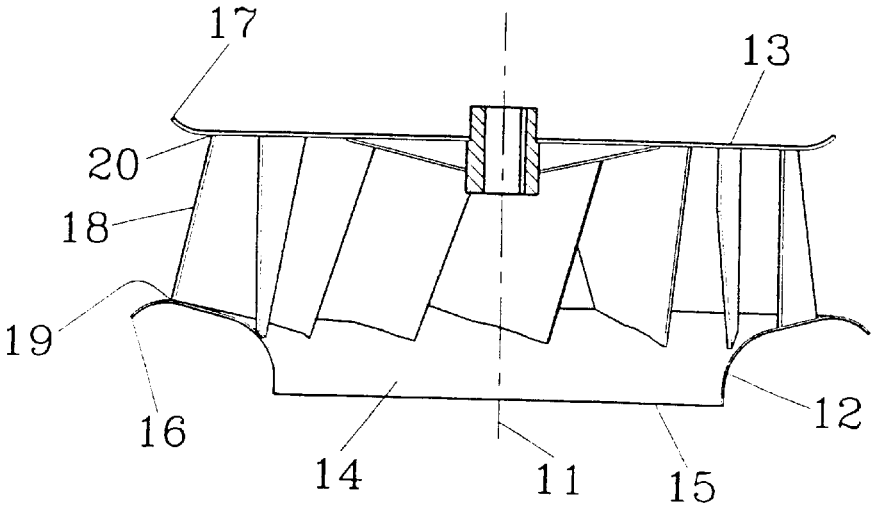
FIG. 2 is a section along the line II—II in FIG. 1.
Figure 3:
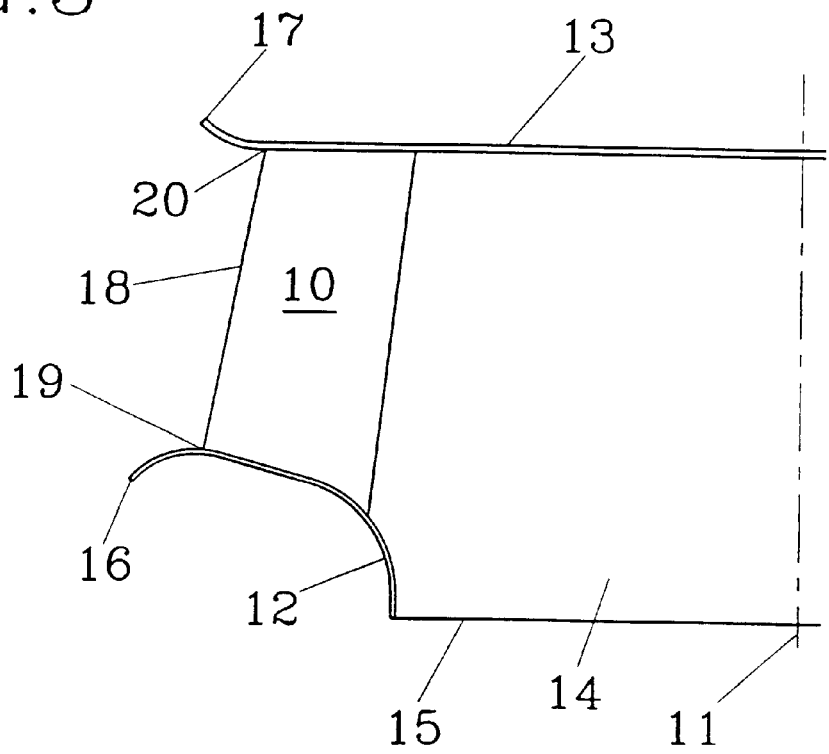
FIG. 3 shows in a larger scale in broken view a first embodiment of a fan wheel according to the invention, corresponding to FIG. 1 and 2.

One of the end plates 12 is provided with a central air inlet 14 and it has a larger diameter than the other end plate 13. The end plate 12 is shaped with a curve extending substantially arched from the inlet edge 15, in the direction toward the other end plate 13 and further radially out toward the peripheral edge 16 which is curved away from the other end plate 13. By this design of the end plate 12, a zone is created beyond the blades 10, where the air velocity is equalized, while maintaining the kinetic energy, which means that less noise is generated downstream the fan wheel. As is illustrated by FIG. 2 and 3, also the peripheral edge 17 of the other end plate 13 is curved away from the end plate 12 which is provided with the air inlet 14. This curving of the peripheral edge 17 of the other end plate 13 contributes to a further equalizing of the air velocity downstream the blades, so that the turbulence in this part of the fan is reduced. This in FIGS. 2 and 3 shown fan wheel is primarily intended for use at a fan unit without fan housing, a so called chamber fan. The fan wheel may also be used in a radial fan.

Each blade 10 is so designed in a peripheral segment, that the blade is provided with a larger contact surface at that end plate 12 which is provided with the air inlet 14, than at the other end plate 13. For example, the peripheral edge 18 of each blade 10 may be straight or curved obliquely, so that this edge meets the inside of the end plate 12 on a point 19 at a distance from the axis of rotation 11 which is larger than the distance between said shaft and the point 20 where the peripheral edge 18 meets the other end plate 13. The design of the blades means, that air that moves between two blades will be accelerated somewhat less if it moves along the end plate 13, than if it moves along the end plate 12. By this design of the blades, the air will leave the fan wheel with varying kinetic energy, which means that pressure pulses are reduced at the downstream side of the fan wheel.

Figure 4:
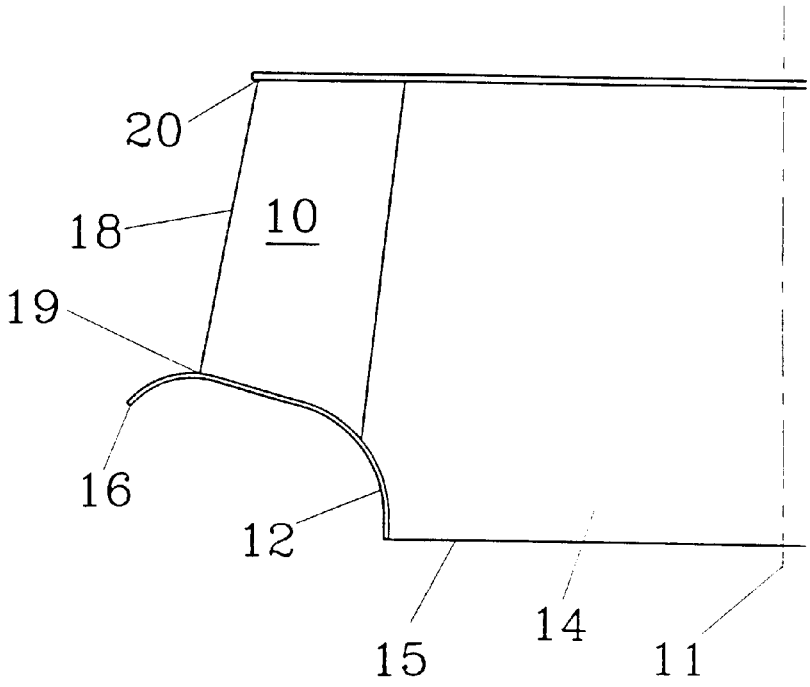
FIG. 4 shows in a corresponding way a second embodiment of a fan wheel according to the invention.

FIG. 4 shows a fan wheel in which the second end plate 13 is completely flat. This fan wheel functions in accordance with the invention, with reduction of noise while maintaining the working efficiency. The fan wheel according to FIG. 4 is primarily intended to be used at a single or double suction radial fan, wherein in the latter case two fan wheels are placed together with the end gables 13 against each other.

The design of the fan wheel in accordance with the invention, provides a considerable reduction of the sound level in the range 50–300 Hz with maintained fan capacity. When using the fan wheel for delivering air to a ventilation system, it will be possible to reduce the design length of the system, which will make it less space consuming and cheaper to build. Because of the reduction in design length and that the need for silencers is reduced, also the pressure drop in the system is reduced, so that the ventilation capacity increases. This also leads to decreased running costs for the system, due to the reduction in power consumption.

The invention is not limited to the above described embodiments, instead more variants are conceivable within the scoop of the following claims. For example, the peripheral edges of the blades may be designed in many ways, in order to provide varying kinetic energy for the air which leaves the fan blades.

I claim:

1. A radial fan wheel for transporting air in ventilation equipment comprising:

a) a number of fan blades (10) symmetrically arranged with substantially equal spacing around the rotational shaft (11) of the fan wheel, b) the fan blades being mounted between two end plates (12, 13) that are arranged perpendicularly to said shaft and are provided with blade surfaces which are substantially parallel to said shaft and each of which blade surfaces extends from one point at a distance from said shaft and substantially arched in the direction outwardly toward the periphery of the wheel, c) one first end plate (12) is provided with a central air inlet (14), and is shaped with a curve that, in a position radially outwardly from the innermost edges of the blades, substantially arches towards the second end plate (13) and further radially outwardly towards the peripheral edge (18) of the blades, d) the peripheral part of the first end plate (12) is curved away from the second end plate (13), e) each blade (10) is designed having a peripheral segment which extends radially longer outwardly adjacent the first end plate (12) than at the second end plate (13) and f) the peripheral edge (18) of each blade has a bevel cut edge so that this latter edge meets the first end plate (12) at a point (19) situated at a distance from the rotation shaft (11) which distance is greater than the distance between said shaft and the point (20) where the peripheral edge (18) of the blade meets the second plate (13).

2. A radial fan wheel according to claim 1, characterized in that the peripheral edge (17) of the second end plate (13) is curved away from the end plate (12) being provided with the air inlet (14).

3. A radial fan wheel according to claim 1 or 2, characterized in that the peripheral edge (18) of each blade (10) extends substantially straight between the two points (19, 20).

* * * * *